US009252483B2

(12) United States Patent
Gottl et al.

(10) Patent No.: US 9,252,483 B2
(45) Date of Patent: Feb. 2, 2016

(54) ACTIVE ANTENNA SYSTEM

(75) Inventors: Maximilian Gottl, Frasdorf (DE); Carl Fredrik Lindgren, Stockholm (SE)

(73) Assignee: KATHREIN-WERKE KG, Rosenheim (DE)

( * ) Notice: Subject to any disclaimer, the term of this patent is extended or adjusted under 35 U.S.C. 154(b) by 559 days.

(21) Appl. No.: 13/532,925

(22) Filed: Jun. 26, 2012

(65) Prior Publication Data

US 2013/0342422 A1 Dec. 26, 2013

(51) Int. Cl.

| | |
|---|---|
| ***H01Q 3/22*** | (2006.01) |
| ***H01Q 1/50*** | (2006.01) |
| ***H01Q 3/26*** | (2006.01) |
| ***H01Q 21/08*** | (2006.01) |
| ***H01Q 21/26*** | (2006.01) |
| *H01Q 1/24* | (2006.01) |
| *H01Q 25/00* | (2006.01) |

(52) U.S. Cl.

CPC ..... *H01Q 1/50* (2013.01); *H01Q 1/246* (2013.01); *H01Q 3/26* (2013.01); *H01Q 21/08* (2013.01); *H01Q 21/26* (2013.01); *H01Q 1/24* (2013.01); *H01Q 25/00* (2013.01)

(58) Field of Classification Search

CPC ..... H01Q 1/24; H01Q 25/00; H01Q 3/26; H01Q 1/50; H01Q 1/246; H01Q 21/08; H01Q 21/26

USPC ..... 342/375

See application file for complete search history.

(56) References Cited

U.S. PATENT DOCUMENTS

| | | | | |
|---|---|---|---|---|
| 5,793,507 | A * | 8/1998 | Giles et al. | 398/68 |
| 6,167,039 | A * | 12/2000 | Karlsson et al. | 370/342 |
| 2008/0291087 | A1 | 11/2008 | Tietjen et al. | |
| 2009/0058724 | A1 * | 3/2009 | Xia et al. | 342/368 |
| 2010/0225552 | A1 | 9/2010 | Shimizu et al. | |
| 2010/0311353 | A1 | 12/2010 | Teillet et al. | |

FOREIGN PATENT DOCUMENTS

| | | | |
|---|---|---|---|
| DE | 4322863 | A1 | 1/1995 |
| DE | 698 37 596 | T2 | 9/2007 |
| EP | 1 684 378 | A1 | 7/2006 |
| WO | 03/052866 | A1 | 6/2003 |
| WO | 2006/071152 | A1 | 7/2006 |

OTHER PUBLICATIONS

International Search Report and Written Opinion of the International Searching Authority dated Oct. 2, 2013, issued in corresponding International Application No. PCT/EP2013/001756.

Balanis, Constantine A., Antenna Theory, Analysis and Design, Third Edition, "6.8.2 Binomial Array," 2005, pp. 328-331, John Wiley & Sons, Inc., Hoboken, New Jersey, US.

* cited by examiner

*Primary Examiner* — Frank J McGue

(74) *Attorney, Agent, or Firm* — Nixon & Vanderhye P.C.

(57) ABSTRACT

An improved active antenna system is distinguished inter alia by the following features:

comprising a first antenna group (5) which is provided for transmitting and receiving operation, comprising a second antenna group (10) which is provided for receiving operation, the two antenna groups (5, 10) are arranged above one another, and the supply network (N11, N12) of the first antenna group (5) has an amplitude distribution which is frequency-dependent, i.e. dependent on a transmitting and a receiving frequency.

28 Claims, 11 Drawing Sheets

$$D_{1,5} = | A_{Rx1,5} - A_{Tx1,5} | = | 0 \text{ dB} - (-6 \text{ dB}) | = 6 \text{ dB}$$

$$D_{1,5} = | A_{Rx1,5} - A_{Tx1,5} | = | 0 \text{ dB} - (-6 \text{ dB}) | = 6 \text{ dB}$$

$$D_1 = | A_{Rx1} - A_{Tx1} | = | 0 \text{ dB} - (-6 \text{ dB}) | = 6 \text{ dB}$$

$$D_5 = | A_{Rx5} - A_{Tx5} | = | -12 \text{ dB} - (-6 \text{ dB}) | = 6 \text{ dB}$$

$$D_{1,9} = | A_{Rx1,9} - A_{Tx1,9} | = | 0 \text{ dB} - (-12 \text{ dB}) | = 12 \text{ dB}$$

$$D_{2,8} = | A_{Rx2,8} - A_{Tx2,8} | = | -3 \text{ dB} - (-9 \text{ dB}) | = 6 \text{ dB}$$

$$D_{1,9} = | A_{Rx1,9} - A_{Tx1,9} | = | 0 \text{ dB} - (-12 \text{ dB}) | = 12 \text{ dB}$$

$$D_{2,8} = | A_{Rx2,8} - A_{Tx2,8} | = | -6 \text{ dB} - (-9 \text{ dB}) | = 3 \text{ dB}$$

$$D_{1,9} = | A_{Rx1,9} - A_{Tx1,9} | = | 0 \text{ dB} - (-12 \text{ dB}) | = 12 \text{ dB}$$

$$D_{2,8} = | A_{Rx2,8} - A_{Tx2,8} | = | 0 \text{ dB} - (-9 \text{ dB}) | = 9 \text{ dB}$$

$$D_1 = | A_{Rx1} - A_{Tx1} | = | 0\ dB - (-12\ dB)\ dB | = 12\ dB$$

$$D_2 = | A_{Rx2} - A_{Tx2} | = | -3\ dB - (-9\ dB)\ dB | = 6\ dB$$

$$D_8 = | A_{Rx8} - A_{Tx8} | = | -21\ dB - (-9\ dB)\ dB | = 12\ dB$$

$$D_9 = | A_{Rx9} - A_{Tx9} | = | -24\ dB - (-12\ dB)\ dB | = 12\ dB$$

$$D_2 = | A_{Rx2} - A_{Tx2} | = | -3\text{ dB} - 0\text{ dB} | = 3\text{ dB}$$

$$D_8 = | A_{Rx8} - A_{Tx8} | = | -21\text{ dB} - 0\text{ dB} | = 21\text{ dB}$$

$$D_9 = | A_{Rx9} - A_{Tx9} | = | -24\text{ dB} - 0\text{ dB} | = 24\text{ dB}$$

$$D_1 = | A_{Rx1} - A_{Tx1} | = | 0\text{ dB} - (-3\text{ dB}) | = 3\text{ dB}$$

$$D_8 = | A_{Rx8} - A_{Tx8} | = | -21\text{ dB} - (-3\text{ dB}) | = 18\text{ dB}$$

$$D_9 = | A_{Rx9} - A_{Tx9} | = | -24\text{ dB} - (-3\text{ dB}) | = 21\text{ dB}$$

ACTIVE ANTENNA SYSTEM

As is known, mobile communications networks are constructed in such a way that they are divided up into a plurality of individual mobile communications cells. The mobile communications cells are formed by supplying a particular region with radio signals by means of base stations. For this purpose, the base stations are equipped with antennas which have an appropriate directional characteristic. Conventionally, lobe-shaped directional characteristics are used. The size of the cell and the region to be supplied may for example be changed by setting a downtilt of the directional characteristic differently, and for this purpose for example phase shifters which can be set differently are used in the respective antenna. This change can also be carried out as a function of the number of active users in a cell.

As is known, the antenna of a mobile communications base network is referred to as an antenna array, which is used for transmitting and receiving. In this way, the communication with a mobile phone subscriber who is located in the relevant cell is handled, the term "downlink" often being used synonymously with transmission (as considered from the base station side). The data which are transferred from the mobile phone subscriber to the mobile communications station, and which are thus received by the antenna array, are often referred to as the uplink.

In modern mobile communications networks, there is thus an imbalance between the uplink and the downlink operation as regards the data rates or the respectively received transmission power, that is to say between the receiving and the transmitting operation as considered from the base station side.

This is because base stations generally have antennas having a relatively high antenna gain, and have a relatively high transmission power as a result of corresponding power amplifiers. As a result, in downlink, a relatively high power can be provided at the receiver. On the other hand, however, the mobile communications devices (what are known as mobile phones, smartphones or other mobile communications devices, for example having notebooks which are equipped with corresponding transmitting and receiving means etc.) comprise antennas having only a relatively small antenna gain and a relatively low available transmission power. As a result, in uplink only a relatively low power can be provided at the receiver. This imbalance between the powers in the respective receiver in uplink and downlink has a negative effect, in particular at high data rates.

So as to achieve particular improvements in this context, it has already been proposed in the past to optimise the uplink path further. Attempts have been made to electrically set the resulting vertical radiation diagram for the uplink operation (that is to say for the receiving operation of a base station) and the downlink operation independently of one another.

This is also possible in that, in the meantime, what are known as active antenna systems having various technical configurations are known. It is generally common to all of them that part of the base station technology, preferably the high-frequency electronics (HF electronics) have in the meantime been integrated into the antenna. This leads to a number of advantages, such as a saving on energy, a lower requirement for cables and interfaces, a reduction in the space requirement etc. Ultimately, this also leads to a more visually appealing configuration of antenna arrays and base stations of this type. A predominant technical feature in this context is that the individual antenna radiators or radiator groups are equipped with the aforementioned transmitting and receiving electronics. As a result, it is possible for example to set the downtilt separately for the uplink and for the downlink.

By way of measures of this type, increases in capacity of for example 5% to 20% should be possible by comparison with conventional solutions.

However, there is also a high risk associated with active antennas of this type. The largest risk factor in this context relates to the electronics which are mounted on the mast or in the antenna. This is because the products and thus above all the electronics should generally remain operational without errors for 10 to 15 years, in some cases in the face of highly adverse environmental conditions. What is known as the "mean time between failure" (MTBF), that is to say the period until an electronic unit fails (that is to say a measure of the time without errors) constitutes an important value for being able to describe the expected service life of an active antenna. The more electronics an active antenna contains, the lower the MTBF is.

Conventional systems usually have a time without errors (MTBF) of this type of approximately 50,000 hours. However, this number is in stark contrast to the requirement that products of this type should provide an error-free service life of for example 10 to 15 years.

A mobile communications system and an associated control system are known in principle from WO 03/052866 A1. This prior publication discloses how two antennas having different vertical diagrams can be operated in the same sector of the cell. In this context, it is explained that the ratio between the transmission powers of the antennas is changed, and as a result the respective receiving power in the corresponding receiver is optimised.

From the technical literature, it can be seen that for side-lobe suppression in an antenna array, it is expedient to supply less power to the outermost radiator of the antenna array than to the central radiators. This principle is disclosed for example in the reference work "Antenna Theory third edition" by Constantine A. Balanis, in the section "6.8.2 Binomial Array".

EP 1 684 378 A1 discloses an array antenna which comprises two passive subgroups having mechanical phase shifters which are arranged vertically with respect to one another. The phase difference between the two subgroups can be set electrically. For this purpose, a phase shifter adjustment assembly is provided for each of the two subgroups of the antenna array, and is connected via a separate downstream distribution network to the individual radiator elements of the two array subgroups.

A conventional antenna having radiators which are arranged above one another and supplied together via a network is also known from WO 2006/071152 A1.

By contrast, the object of the present invention is to provide an improved solution which is adapted to reduce or balance the existing imbalance between an uplink operation and a downlink operation in an antenna system for mobile communications, that is to say between the receiving and transmitting operation, and thus to reduce as a whole the drawbacks which result from the existing imbalance between an uplink and a downlink.

As a matter of basic principle, a major improvement is not possible on the mobile communications user side, that is to say on the part of the mobile phone, smartphone or other mobile communications device which is being used, because only a low energy supply is available and the antenna gain is low as a result of constructional constraints, and the invention therefore deals with the base station side.

In the context of the invention, it is proposed to use an antenna array which comprises at least a first and a second antenna group.

Whilst the first antenna group is provided for transmitting and receiving operation, the second antenna group should be provided only or predominantly only for receiving operation. The antenna groups, which each comprise at least two antenna subgroups (each antenna subgroup comprising at least one radiator), are arranged above one another.

In this context, the phases and powers for the antenna subgroups can be provided via a supply network, mechanical phase shifters preferably being provided.

So as now to make an improvement possible between the uplink and downlink operation, the invention proposes a frequency-dependent amplitude distribution at least for the first antenna group, which is provided for transmitting and receiving operation.

In this context, the amplitude distribution within an antenna array is understood to mean the relative distribution of the signal levels which are present at the various individual antenna subgroups in transmitting or receiving operation. The signal is preferably an electrical signal in the form of a voltage, a current or a power. This is standardised by giving the level in dB. Conventionally, the signal levels are normalised to the maximum signal level of any one of the antenna subgroups during transmitting or receiving operation. However, it may also be expedient to relate the signal levels to the level of a selected antenna subgroup in transmitting or receiving operation. Instead of a signal level, it is also possible simply to speak of an amplitude, which for simplicity is given in relative terms.

The amplitude distribution for the transmitting and receiving operation of the first antenna group is different in this context. Simply put, the difference may be that the amplitude of the antenna subgroups decreases from a highest value, preferably represented by a central antenna subgroup, to the outermost antenna subgroups in transmitting operation (downlink). Further, however, there are also application scenarios in which all of the antenna subgroups in downlink are supplied with the same amplitude, or only some individual antenna subgroups receive somewhat more power. However, the first suggested embodiment is preferred. By contrast, however, in receiving operation (uplink) the amplitudes of the outermost or penultimate antenna subgroups of the first antenna group are changed, on the basis of a highest amplitude of any one of these antenna subgroups. The amplitudes may be equal to the maximum amplitude of any one of the antenna subgroups (that is to say preferably not lower) or preferably only slightly lower or even decreasing more strongly than in transmitting operation.

Assuming that the amplitude of the outermost or the penultimate antenna subgroup, on the basis of the highest amplitude of the antenna subgroup, has a value $A_{Rx}$ at a receiving frequency, and also assuming in the present case that the amplitude of the outermost or penultimate antenna subgroup, on the basis of the highest amplitude of the antenna subgroup, has a value $A_{Tx}$ at a transmitting frequency, in the context of the invention the absolute value of the difference between the two abovementioned values should be at least 0.2 dB multiplied by the number of antenna subgroups and at most 5 dB multiplied by the number of antenna subgroups.

As a result of this measure, it is provided above all that the described imbalance between the uplink and the downlink operation is considerably improved by comparison with conventional solutions, even in the case of relatively strongly attenuated sidelobes. Attenuated sidelobes have the advantage that in particular the first sidelobe above the primary lobe radiates more weakly in adjacent mobile communications cells. The resulting interferences are thus reduced.

In a preferred embodiment of the invention, it is possible to use the signals which are received via the two antenna groups, by methods such as MRC (maximum ratio combining) or ERC (equal ratio combining) or methods such as IRC (interference rejection combining) or the like. The processing takes place in a transmitting and receiving unit. The method thus involves the combination of signals of individual antennas or groups which can be used for a diversity gain in the case of existing receive diversity. Further, it is conceivable to change, within the transmitting and receiving unit, the phases of the signals which are supplied to the two antenna groups. As a result, it is possible for example to set a separate downtilt for the receiving operation by comparison with the transmitting operation.

A simple implementation of the invention is also provided in particular if mechanical phase shifters are used for the frequency-dependent amplitude distribution in the supply network.

For the frequency-dependent amplitude distribution in the supply network, however, it is also possible to use frequency-dependent power splitters.

The novel architecture according to the invention of the antenna array and the supply thereof also has the result that only one transmitter and only two receivers are required per polarisation in a dual-polarised radiator arrangement, for example. A dual-polarised active antenna according to the invention may also for example be implemented with only two remote radio heads (or comparable components) having the associated electronics and filter components for two integrated transmission branches (TX branches) and four receiving branches (RX branches) of a dual-polarised antenna array. If it were desired to use a conventional architecture, so as to provide and implement effects which are only somewhat similar, it would be necessary for this purpose to integrate electronics and filters for at least ten transmission branches and twenty receiving branches (for example in the case of five antenna subgroups in every antenna group), so as to achieve a result which is only somewhat similar. Also, predominantly as a result of the fact that in the context of the invention, in the receiving operation of the mobile communications antenna (uplink in relation to the base station), the signals of two antenna arrays are combined with one another, an additional antenna gain is achieved of approximately 2.5 to 3.0 dB more than in the downlink (transmitting operation), in which only one antenna array is used. As a result of the aforementioned modern methods for combining signals of individual antennas (for example MRC, ERC, IRC etc.), a further 1.0 to 3.0 dB is additionally gained. As a result of a novel active antenna of this type, a power improvement of approximately 3.5 to 6.0 dB is thus achieved in total in uplink operation (receiving operation) by comparison with the downlink operation (transmitting operation). This leads to a major improvement in the data rates. Moreover, the uplink and downlink signals can be set to different downtilt values, and this makes further optimisation of the data rates possible. Previously, this was only possible by means of what are known as distributed active antenna architectures.

However, it would also be conceivable to operate both of the antenna groups in transmitting operation. Thus for example an intelligent method such as MIMO, SIMO or MISO can be applied, just as in the joint operation of the antennas in downlink operation, for example for a higher gain.

In the following, the invention is described in greater detail by way of embodiments, with reference to the appended drawings, in which, in detail:

Figure 1:
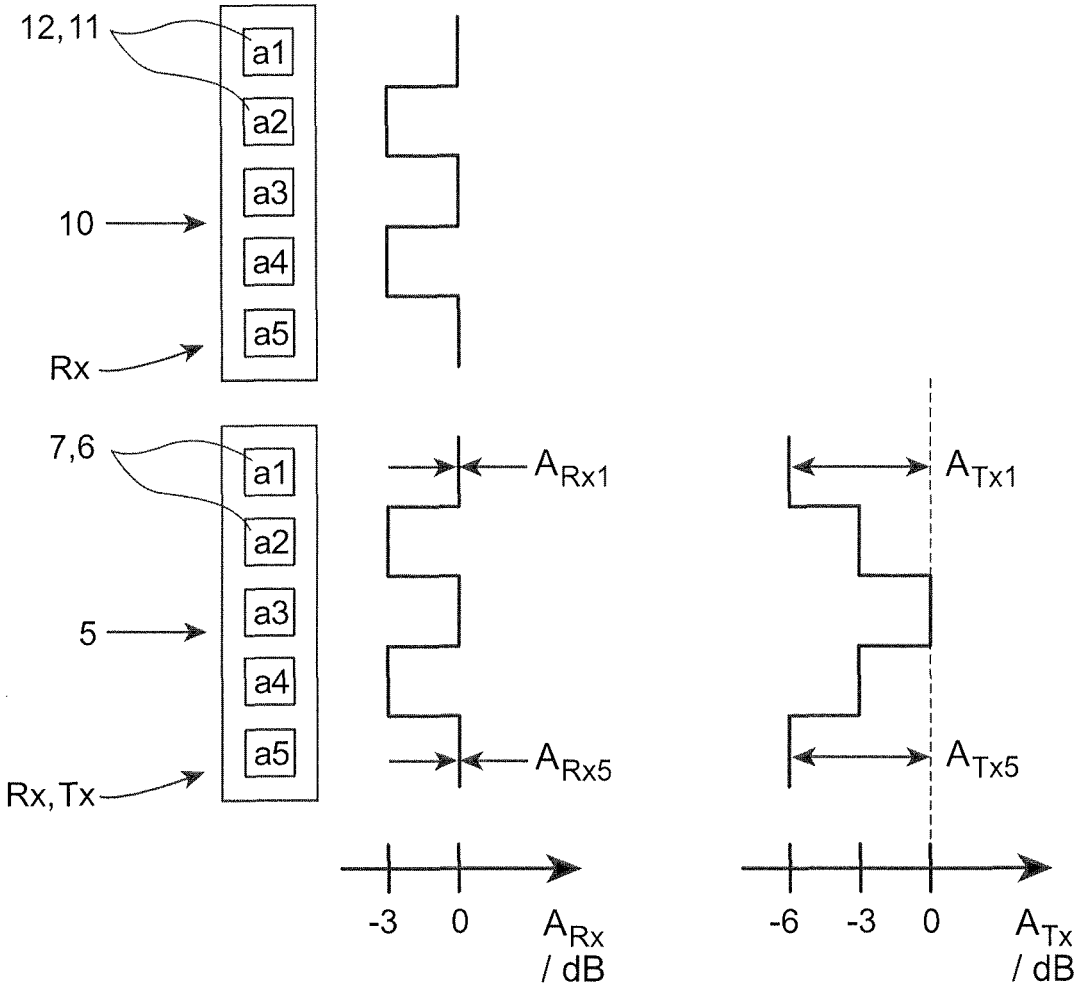
FIGS. 1 to 3 show three embodiments of an antenna array according to the invention along with the associated frequency-dependent amplitude distribution.
Figure 8A:
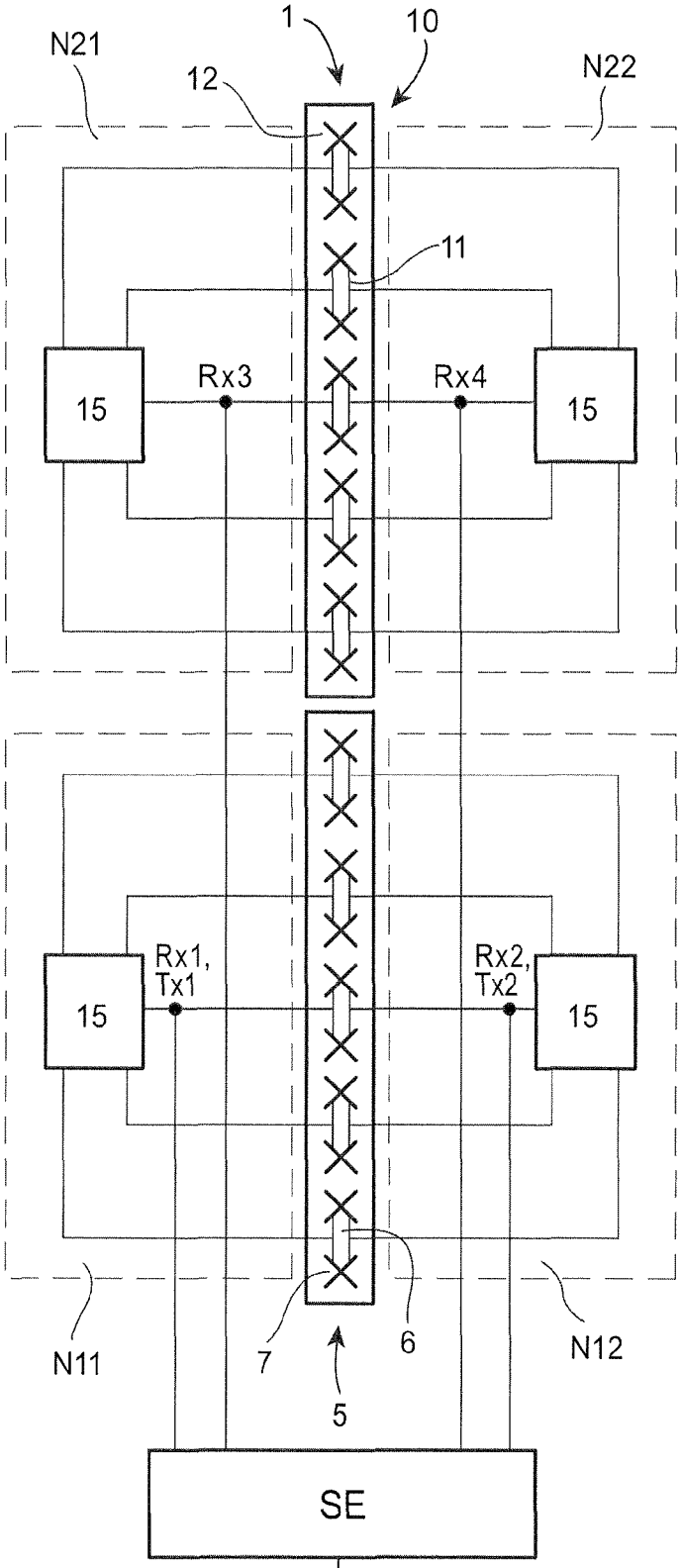
Figure 8B:
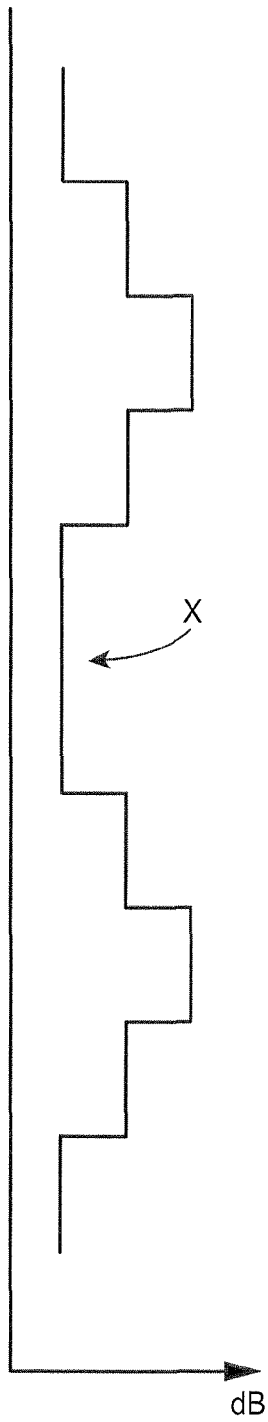
Figure 9:
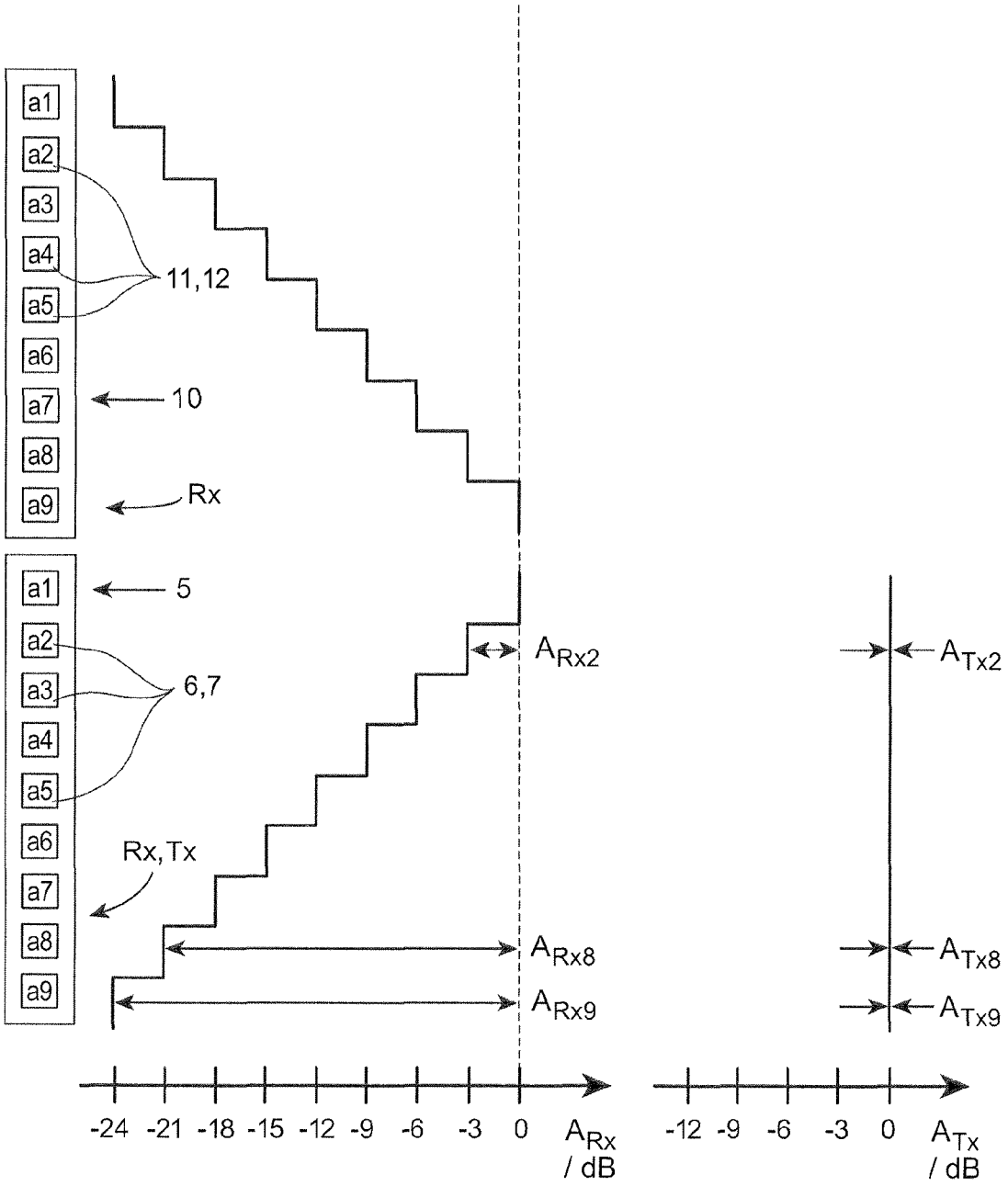
Figure 10:
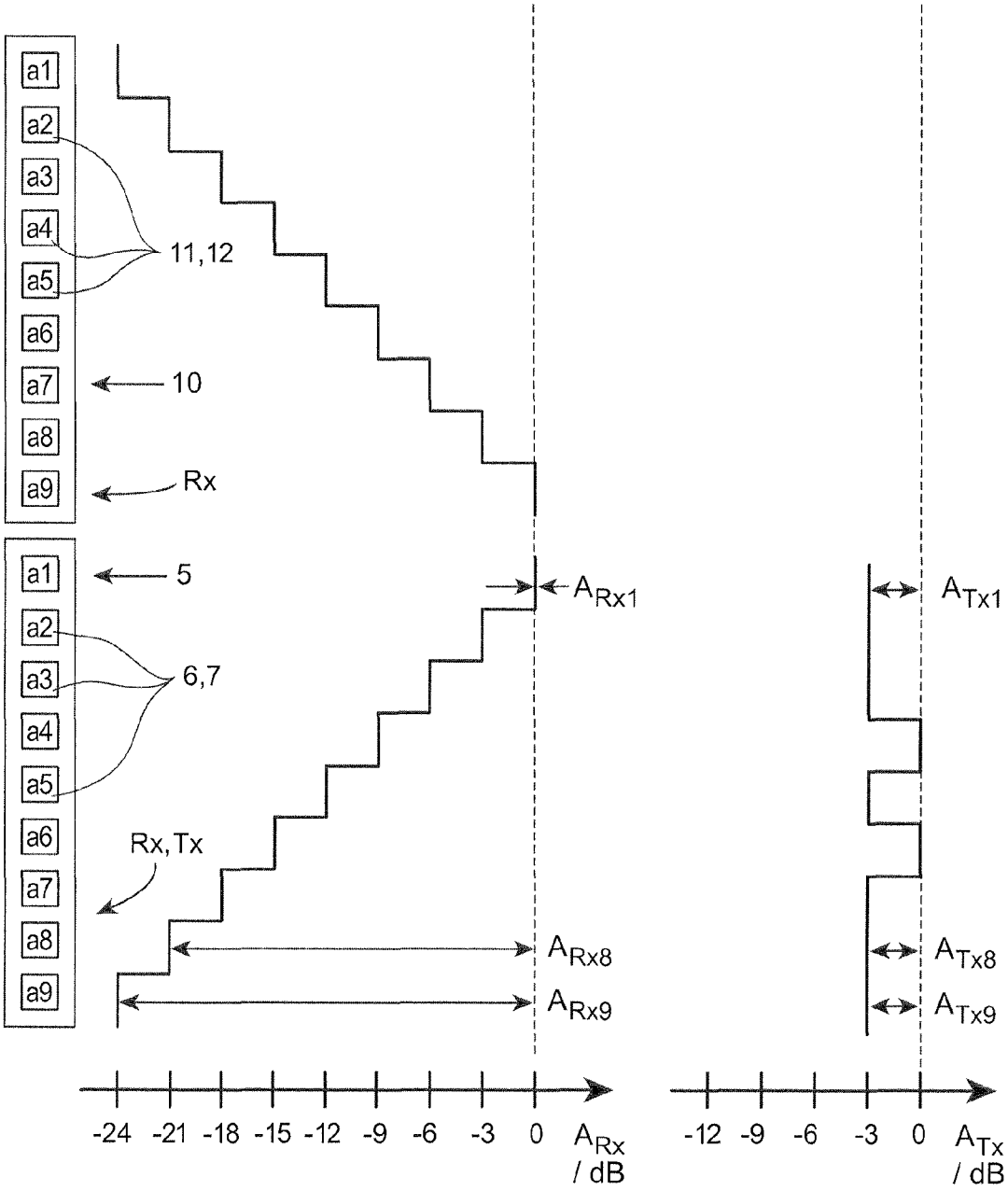
Figure 11:
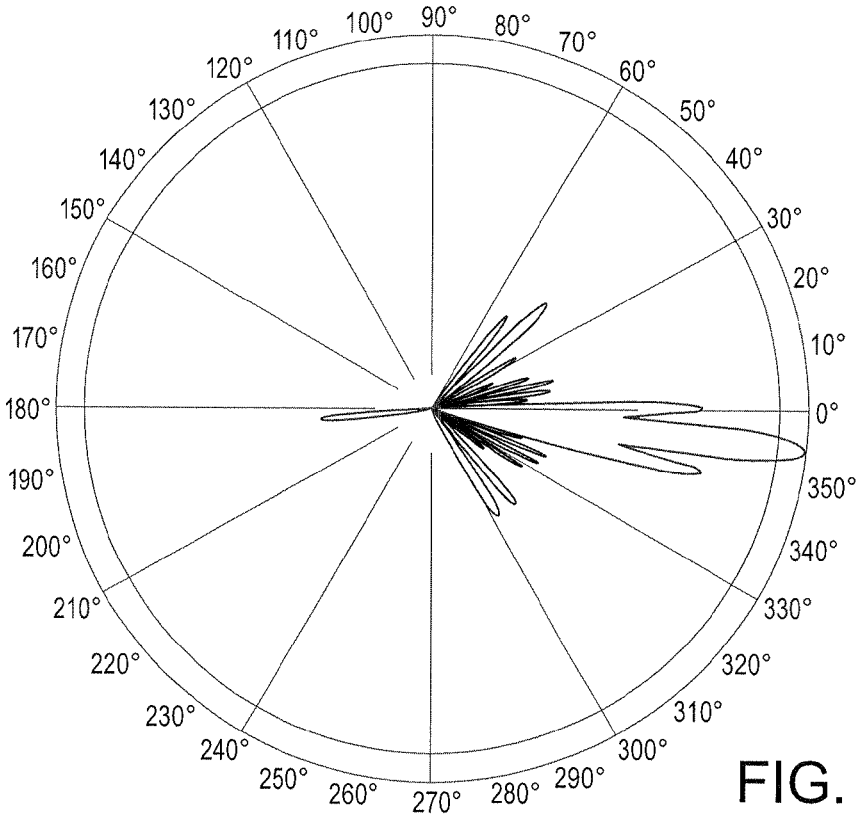
Figure 12:
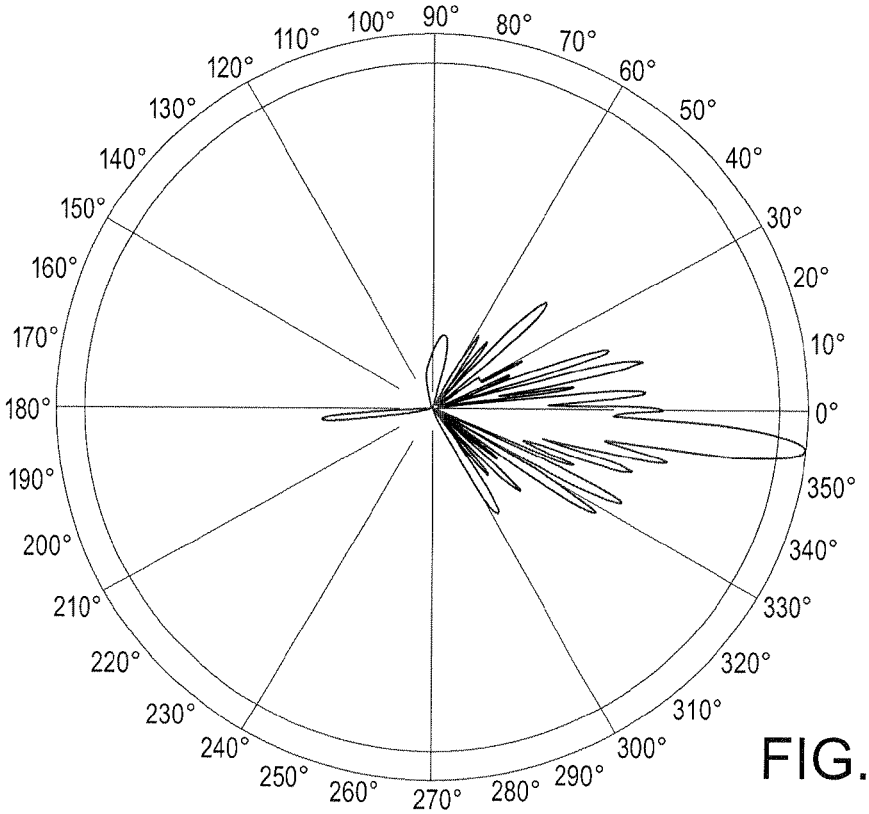

FIG. 8*a* shows an antenna array in accordance with the prior art;

FIG. 8*b* shows a supply of the antenna array which is known in accordance with the prior art according to FIG. 8*a*, also in accordance with the prior art;

FIGS. 9 and 10 show two further, modified embodiments of an antenna array according to the invention;

FIG. 11 is a vertical radiation diagram of an antenna array according to FIG. 8*a* in an amplitude distribution according to FIG. 8*b* in receiving operation; and FIG. 12 is a vertical radiation diagram of an antenna array according to FIG. 8*a* in an amplitude distribution according to FIG. 1 in receiving operation.

In the following, reference is initially made to FIG. 8*a*, which is a schematic drawing of an antenna array 1 such as has previously been operated in accordance with the prior art. The antenna array 1 comprises for example two antenna groups 5, 10 which are arranged above one another (generally vertically above one another). In this context, the lower antenna group 5 is also referred to in the following as the first antenna group 5. The upper antenna group 10 is also referred to as the second antenna group.

Each of the two antenna groups 5, 10 consists of at least two antenna subgroups 6 and 11 respectively, each antenna subgroup comprising at least one radiator. In the embodiment shown, in accordance with the prior art, both the first and the second antenna group 5, 10 each comprise five antenna subgroups 6 and 11 respectively, each of the antenna groups comprising at least one radiator, i.e. in the embodiment shown two radiators 7, 12 in each case. In the embodiment shown, the radiators are dual-polarised radiators, which are preferably respectively orientated at a +45° and a −45° angle to the horizontal or vertical. In this regard, it is also common to refer to X-polarised radiators, which can be operated in two mutually perpendicular polarisation planes.

In each case, the radiators which belong to the same antenna subgroup can be supplied with the same phase position and/or power, although fixed phase shifter elements may preferably also be arranged between every two radiators of this type which belong to a radiator subgroup, in such a way that two radiators which belong to an antenna subgroup can be supplied with a fixedly predetermined, i.e. generally non-adjustable, phase difference.

The radiators 7 of the first antenna group 5 are used both in transmitting and in receiving operation, whereas the radiators 12 of the second antenna group are only used in receiving operation.

Thus, in the described example in accordance with the prior art according to FIG. 8*a*, the radiators 7 and 12 in the antenna groups 5, 10 of the antenna array are interconnected via cables or coaxial systems or other systems by means of phase shifters 15. The antenna array is generally of a broadband configuration and covers the receiving and transmitting frequencies. So as to achieve the best possible sidelobe suppression for interference reduction, the phase shifters are configured with what are known as decreasing power shares (power tapering). That is to say, the radiators which are arranged more in the centre or in the central region of the respective antenna group 5, 10 receive higher power shares than the radiators 7, 12 or antenna subgroups 6, 11 which are positioned at the outer edge or adjacent to the outer edge (see FIG. 8*b*). This results in the power distribution which is shown in FIG. 8*b*, which may be optimal for the downlink case, but causes a problem for the uplink case, since a lower power distribution is now provided for the entire antenna array in the central region X, and this results in larger sidelobes, above all in the horizontal orientation or slightly below, which are highly undesirable because they radiate into adjacent cells. FIG. 11 shows a corresponding vertical radiation diagram. In this context, in FIG. 8*b* the respective amplitude or power for the relevant radiators 7, 12 of the respective antenna subgroup 6, 11 of the two antenna groups 5, 10 is shown on the x-axis.

To overcome these drawbacks, a first improved embodiment according to the invention is described in the following by way of FIG. 1. In this context, the above statements relating to the form and construction of the described antenna array also apply equally to the antenna arrays which are used in the following in the context of the invention, except where other, further variants and modifications are provided. To this extent, like reference numerals also denote the same parts, constituents and components which have already been described by way of FIG. 8*a*.

An antenna according to the invention may thus for example be operated in transmitting operation in a frequency band of 2110 MHz to 2155 MHz. The receiving range may for example be between 1710 MHz and 1755 MHz. The following statements apply in principle to any transmission standard or to any frequency band which is used, in particular in the mobile communications range, that is to say for example to the 900 MHz band, to the 1800 MHz or 1900 MHz band, to the UMTS mobile communications standard (which is used in different frequency bands in different countries and regions, for example in the 1920 MHz to 2170 MHz band) and/or for example also to the LTE mobile communications standard etc. There are no restrictions to particular frequency ranges in this regard. It should merely be assumed that mutually offset frequency bands or frequency ranges are provided for the uplink (receiving operation) and the downlink (transmitting operation). For the embodiments according to the invention which are described further in the following, it is also found to be advantageous if the number of antenna subgroups 6, 11, but also the number of radiators 7, 12 per antenna group, is the same, although it is also possible for an unequal number of antenna subgroups 6, 11 or radiators 7, 12 to be present.

The dual-polarised radiators which are preferably described by way of FIG. 8*a* may also be polarised in a +45° and −45° plane (although this is not a compulsory requirement) in the antenna arrays according to the invention. Further, they may also be of a horizontal or vertical, right-handed or left-handed, circular or elliptical polarisation, or else merely be horizontally or vertically polarised. All of the aforementioned polarisations or polarisation combinations may also equally be used in the context of the embodiments according to the invention which are described in greater detail in the following.

The construction of the antenna array according to the invention in accordance with FIG. 1 thus corresponds in principle to the one which was described for the prior art by way of FIG. 8*a*. In receiving operation, that is to say in uplink operation, the corresponding receiving signals Rx (uplink) for each of the two antenna groups 5, 10 and for each polarisation are supplied to a supply point Rx1 or Rx2 respectively by way of a supply network N11 or N12 respectively for the first antenna group 5 (for signals which are transmitted in the first polarisation plane and in the second polarisation plane respectively). In this context, the supply points Rx1 and Rx2 are also used as feed points for the transmission signals (downlink), that is to say as supply points Tx1 and Tx2, so as to feed the signals for the two polarisations for the first antenna group 5 into the associated supply network N11 or N12 (depending on the polarisation) by means thereof.

For the second or upper antenna group 10, a corresponding supply network N21 and N22 is provided for the two polarisation planes, and generally only receiving signals $R_x$ (uplink) are received and no transmitting signals $T_x$ (downlink) are transmitted by means thereof. If a single-polarised antenna array is to be used, naturally only one corresponding supply network would be provided in each case for the one used polarisation of the first or second antenna group.

In this context, the described antenna groups 5, 10 are connected to a shared transmitting and receiving unit SE, which may for example consist of a remote radio head (RRH) which is mounted close to the antenna or in the antenna (on the antenna mast) or comprise a remote radio head (RRH). It is also possible for the transmitting and receiving unit additionally to function as a baseband unit and to carry out corresponding processing, in particular intelligent methods.

In the context of the invention, a frequency-dependent power or amplitude distribution is now used for the resulting radiation diagram, i.e. a different power or amplitude distribution for the uplink and the downlink case. In the first embodiment according to the invention, as described by way of FIG. 1, an antenna array comprising a first or lower antenna group 5 and a higher or second antenna group 10 (generally located vertically above) is again shown in a simplified manner on the left-hand side of FIG. 1, each antenna group in the embodiment shown again comprising five antenna subgroups 6, 11. Each of the antenna subgroups comprises at least one or more radiators 7, 12, as was described by way of FIG. 8*a*.

In this context, in the drawings according to the invention in accordance with FIGS. 1 to 7, the first or lower antenna group 5 and the upper or second antenna group 10 having the antenna subgroups 6, 11 are merely shown in a simplified manner. In this context, the individual antenna subgroups are each labelled in sequence from top to bottom with the individual allocations a1, a2, a3, a4 and a5 respectively, both for the first antenna group 5 and for the second antenna group 10. These antenna subgroups 6, 11 may also be configurations in which, as described, the provided radiators are merely single-polarised or dual-polarised, are configured in the form of what is known as an X-polarisation, etc. Accordingly, the physical construction in dual-polarised radiators should be implemented in the manner which is described in principle by way of FIG. 8*a*. Therefore, in the following, the amplitude distribution for the individual radiators of the individual antenna subgroups is only shown for one polarisation in each case. In dual-polarised antennas, this generally applies accordingly to both polarisations, i.e. to the signals which are received or transmitted by means thereof. However, it is also possible merely to apply the amplitude distribution according to the invention to one polarisation, or to use different amplitude distributions according to the invention for each polarisation.

Besides the simplified representation of the first and second antenna group 5, 10 on the left-hand side of FIG. 1, the power or amplitude distribution is also shown to the right thereof for each of the antenna subgroups, specifically on an associated horizontal x-axis. Since in the context of the invention preferably not only the first, but the first and the second antenna groups 5, 10 are used for the receiving operation (uplink) of the base station, the power and/or amplitude distribution is shown not only for the first antenna group 5, but also for the second antenna group 10. To the right thereof, the power and/or amplitude distribution is shown for the first or lower antenna group 5, which is only used for transmitting operation, for which reason a corresponding amplitude distribution for the transmitting operation (Tx operation) is only provided for the first antenna group 5.

As a result, in relation to the antenna subgroup 6 of the first antenna group 5, in receiving operation a power or amplitude distribution is provided which alternates between a higher and a lower step, that is to say for example between 0 dB and −3 dB. These are signal level steps.

From this diagram, it can further be seen that predominantly in the central region X, in receiving operation (uplink), there is no longer a power or amplitude distribution which is relatively reduced by comparison with the prior art in accordance with FIG. 8*b*, but instead there is an amplitude distribution having a comparatively higher or larger relative amplitude, in such a way that the sidelobes become smaller, predominantly in the critical uplink case. The resulting radiation diagram for the receiving case can be seen in FIG. 12. The comparison with FIG. 11, which shows a corresponding diagram for the specified prior art, makes the advantage of the solution according to the invention clear.

However, so as also to produce an optimal radiation diagram for the downlink case, the invention further proposes that in transmitting or downlink operation only one antenna group, in the embodiment shown the lower or first antenna group 5, is active, whilst the second or upper antenna group 10 is ineffective for the downlink operation, i.e. no signals are emitted. In this context, power tapering is provided in a similar manner to in the prior art, that is to say power tapering in which there is a higher relative signal level at the central antenna subgroups 11 and/or the associated radiators 12 than at the outer or penultimate antenna subgroups 11.

In accordance with the drawing according to FIG. 1, this results in the preferred solution according to the invention (for example for an antenna array having a first and a second antenna group 5, 10 which each comprises five antenna subgroups 6, 11, specifically having one or more radiators in each antenna subgroup), in which for the receiving operation, for the individual radiators which are positioned side by side in the antenna groups, for example the relative amplitude distribution shown in the centre by way of FIG. 1 is provided. By contrast, in transmitting operation—in which only the first antenna group and the associated radiators are active—the optimum power distribution over the antenna subgroups is provided, which is shown on the right-hand side by way of FIG. 1, and in which the radiators of the central antenna subgroup obtain a much higher power or amplitude than those radiators which are arranged in the outermost or adjacent to the outermost antenna subgroups 6, 11.

Figure 2:
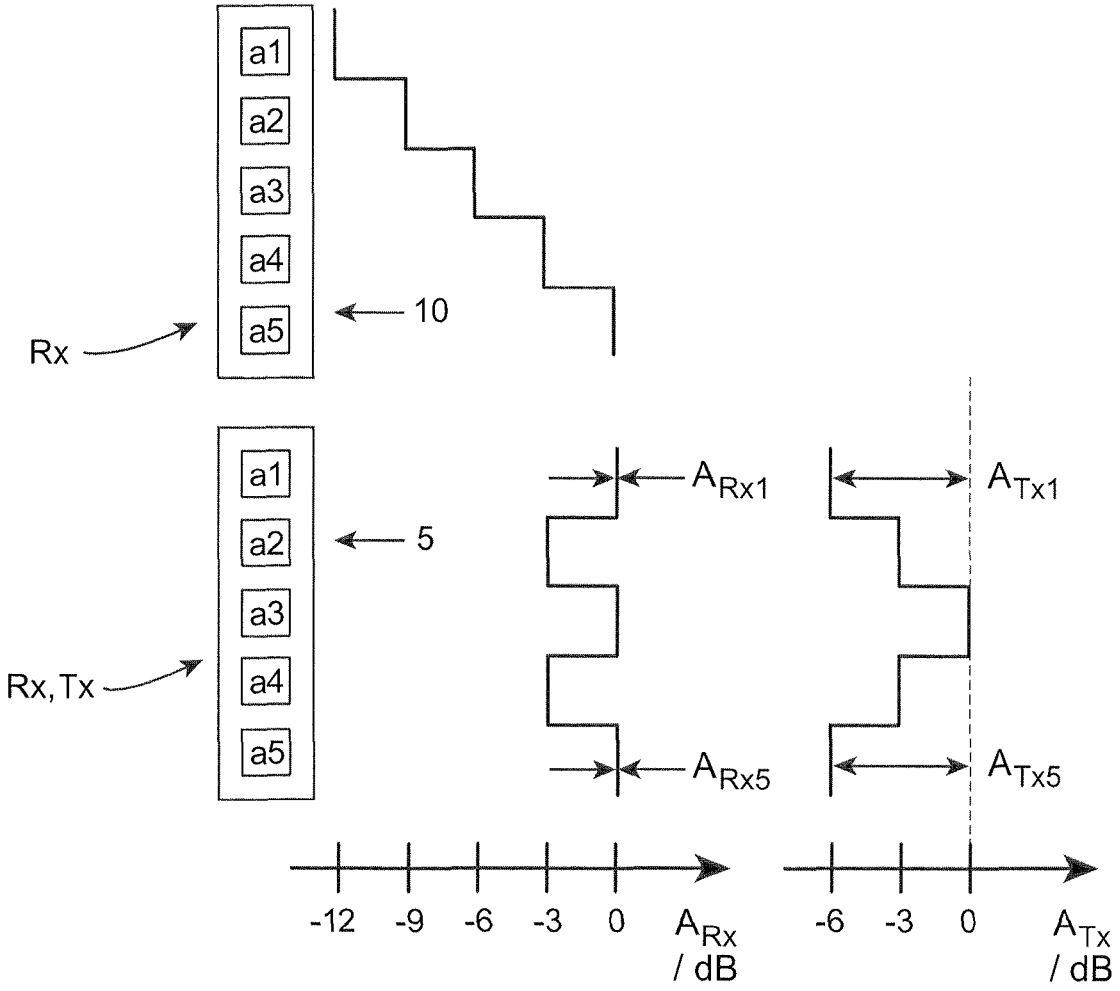

FIG. 2 shows, for a further embodiment according to the invention, how the relative power or amplitude distribution is set in a first receiving operation belonging to the invention.

The embodiment in accordance with FIG. 2 differs from that according to FIG. 1 in that, for the second antenna group 10, the associated lowest radiator 12 or the associated lowest antenna subgroup 11, which is denoted in FIG. 2 as a5 and which is positioned directly adjacent to (above) the first or uppermost antenna subgroup 6, denoted as a1, of the first or lower antenna group 5, obtains the highest power or amplitude in relation to all of the antenna subgroups 11 which are provided in the second antenna group 10. From this lowest antenna subgroup 11 (which as stated is denoted as a5 in FIG. 2), the power or amplitude distribution decreases in steps to the highest antenna subgroup 11 (which is denoted in FIG. 2 as a1), for example by −3 dB per antenna subgroup. As a result, the relative power or amplitude decreases, in the amplitude steps which can be seen in FIG. 2, from the radiators which belong to the innermost or lowest antenna group 11 to the radiators which belong to the outermost or highest antenna subgroup 11, specifically for example in the following steps (dB)

0/−3/−6/−9/−12, and this results in the stepped progression of the power or amplitude distribution in the upper or second antenna group 10 in the uplink or receiving operation. This progression may also, as in the first antenna group, be frequency-dependent. This case would also be conceivable for example if the second antenna group were also intended to work independently of another antenna group in transmitting operation.

The variants in accordance with FIGS. 1 and 2 are merely intended to demonstrate that a different amplitude distribution is possible within wide ranges, in particular in relation to the second antenna group 10, but a distribution is preferred in which the amplitude in the lowest antenna subgroup 11 of the second antenna group 10 corresponds to the amplitude in the adjacent uppermost antenna subgroup 6 of the first antenna group 5. The specified amplitudes are normalised to the maximum. In operation, the amplitudes of the antenna group are preferably set by means of the transmitting and receiving unit SE in such a way that the two antenna groups are supplied with a largely identical amplitude. Equivalent to the receiving case, it can also be said that the received signals are preferably weighted equally in the transmitting and receiving unit SE.

Figure 3:
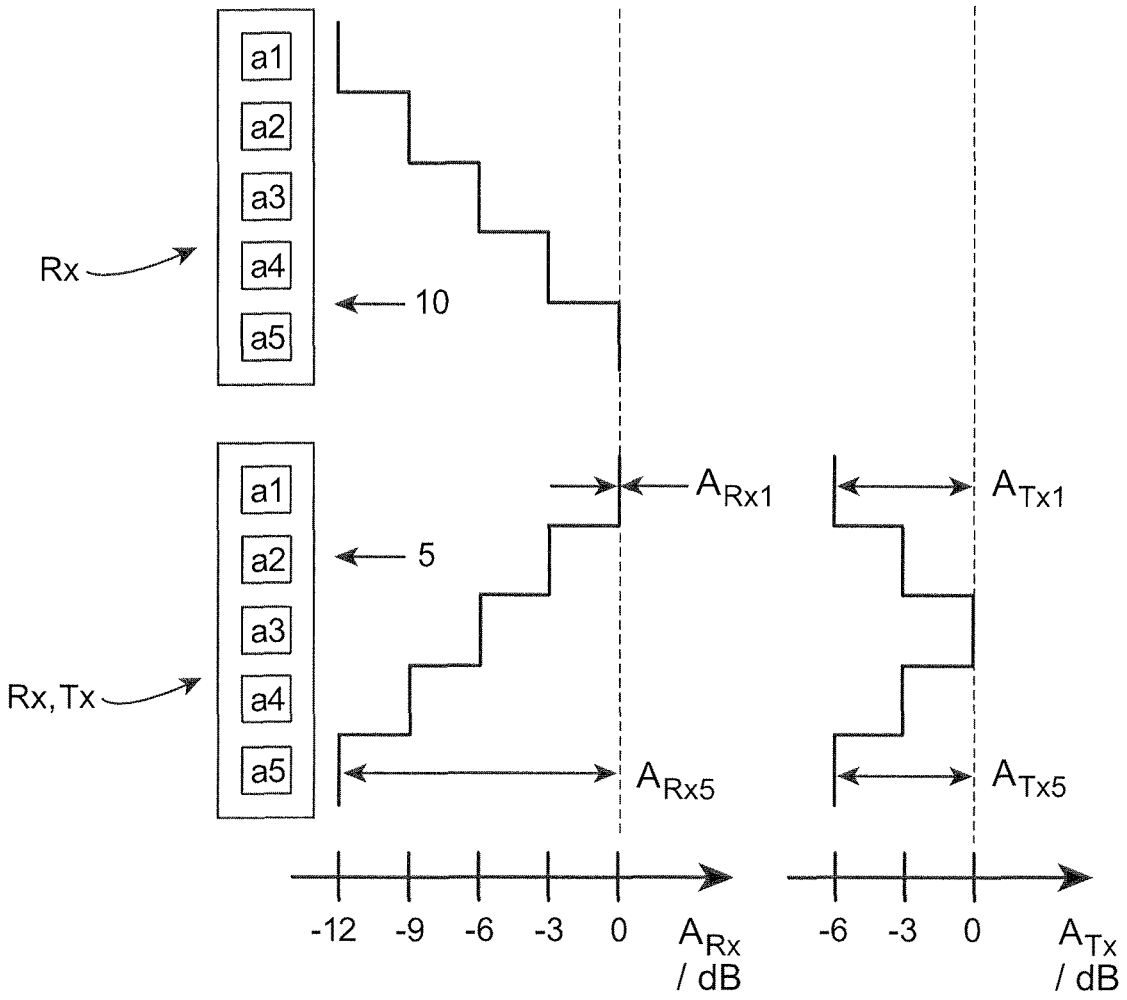

FIG. 3 shows a further modification, in which the amplitude distribution of the first antenna group 5 for the receiving operation (uplink) increases, in steps of 3 dB in each case, from the lowest (outermost) antenna subgroup (denoted as a5 in FIG. 3) to the uppermost antenna subgroup 6 (denoted as a1 in FIG. 3). In this case too, the amplitude distribution is provided in such a way that the amplitude of the antenna subgroup 6 which is uppermost in this case of the first antenna group 5 is equal to the amplitude of the adjacent lowest antenna subgroup 11 of the second antenna group 10. The stepped amplitude progression in relation to the antenna subgroups 11 of the second antenna group 10 otherwise corresponds to the progression which was described by way of embodiment 2.

In the context of the invention, it is primarily the relative power and amplitude distribution between the antenna subgroups 6 of the first antenna group 5 which are relevant for the receiving operation on the one hand and for the transmitting operation on the other hand. In this context, the frequency-dependent amplitude distribution which is proposed in the context of the invention is of importance for the transmitting and receiving operation. The amplitude distribution of the second antenna group 10, which is provided for receiving operation only, may have preferred values in the context of different variants.

The solution according to the invention is characterised by the absolute value of the difference $$D=|A_{Rx}-A_{Tx}|,$$

this absolute difference D being

- at least 0.2 dB multiplied by the number Z of antenna subgroups 6 of the first antenna group 5, and
- and most 5.0 dB multiplied by the number Z of antenna subgroups 6 of the first antenna group 5,
- $A_{Rx}$ being the relative amplitude of the outer or penultimate antenna subgroup 6 on the basis of the highest amplitude of the antenna subgroups 6 of the first antenna group 5 at a receiving frequency, and
- $A_{Tx}$ being the relative amplitude of the outer or penultimate antenna subgroup 6 on the basis of the highest amplitude of the antenna subgroups 6 of the first antenna group 5 at a transmitting frequency.

If in the following reference is made herein to the difference D, this refers, as defined above, to the respective absolute value of the difference.

In a preferred embodiment of the invention, however, the lower limit on the above-mentioned difference D may also be 0.3 dB multiplied by the number Z of antenna subgroups 6 of the first antenna group 5, or in some cases preferably even larger than at least 0.4 dB multiplied by the number Z of antenna subgroups 6 of the first antenna group 5.

Likewise, it may preferably be provided that the upper limit on the relevant difference D is at most 4.0 dB or at most 3.0 dB or in some other cases even at most 2.5 dB or even for some application scenarios 2.0 dB, in each case multiplied by the number Z of antenna subgroups 6 of the first antenna group 5.

When, as above and in connection with the embodiments, reference is made to "outer" or "penultimate" antenna subgroups 6 (or 11), the "outer antenna subgroup", for example in the first antenna group 5, preferably means the lowest (and/or the highest) antenna subgroup 6, which is denoted as a5 (or a1) in the appended embodiments 1 to 3 and as a9 (or a1) in the appended embodiments 4 to 7. Thus, the outer antenna subgroup is preferably the one which is arranged on the side of the first antenna group which is preferably remote from the second or upper antenna group 10. Where reference is made to the penultimate antenna subgroup 6 of the first antenna group 5, this is the adjacent antenna subgroup, which is also preferably remote from the second or upper antenna group 10, but may also optionally be adjacent thereto (and is therefore denoted as a4 or a2 in FIG. 1 to 3 and as a8 or a2 in FIGS. 4 to 7).

For the constraints which are given above, the corresponding values for the first antenna group for the transmitting operation and the receiving operation are given in FIGS. 1 to 3.

In the following, some further examples of solutions according to the invention are described by way of FIGS. 4 to 7, namely for example an antenna array comprising a first and second antenna group 5, 10, which each comprise nine antenna subgroups 6 or 11. In the figures, in each case the antenna subgroups are respectively denoted on the left-hand side starting with a1 at the top to a9 at the bottom in each antenna group. As is also the case in the other embodiments, on the right of the figures, adjacent to the antenna array which is shown in a simplified manner, the associated relative amplitude or power distribution for the individual antenna subgroups and/or for the radiators which are provided in the antenna subgroups is shown, initially for the receiving operation, and subsequently to the right thereof for the transmitting operation, which is only carried out by means of the first (lower) antenna group 5.

Figure 4:
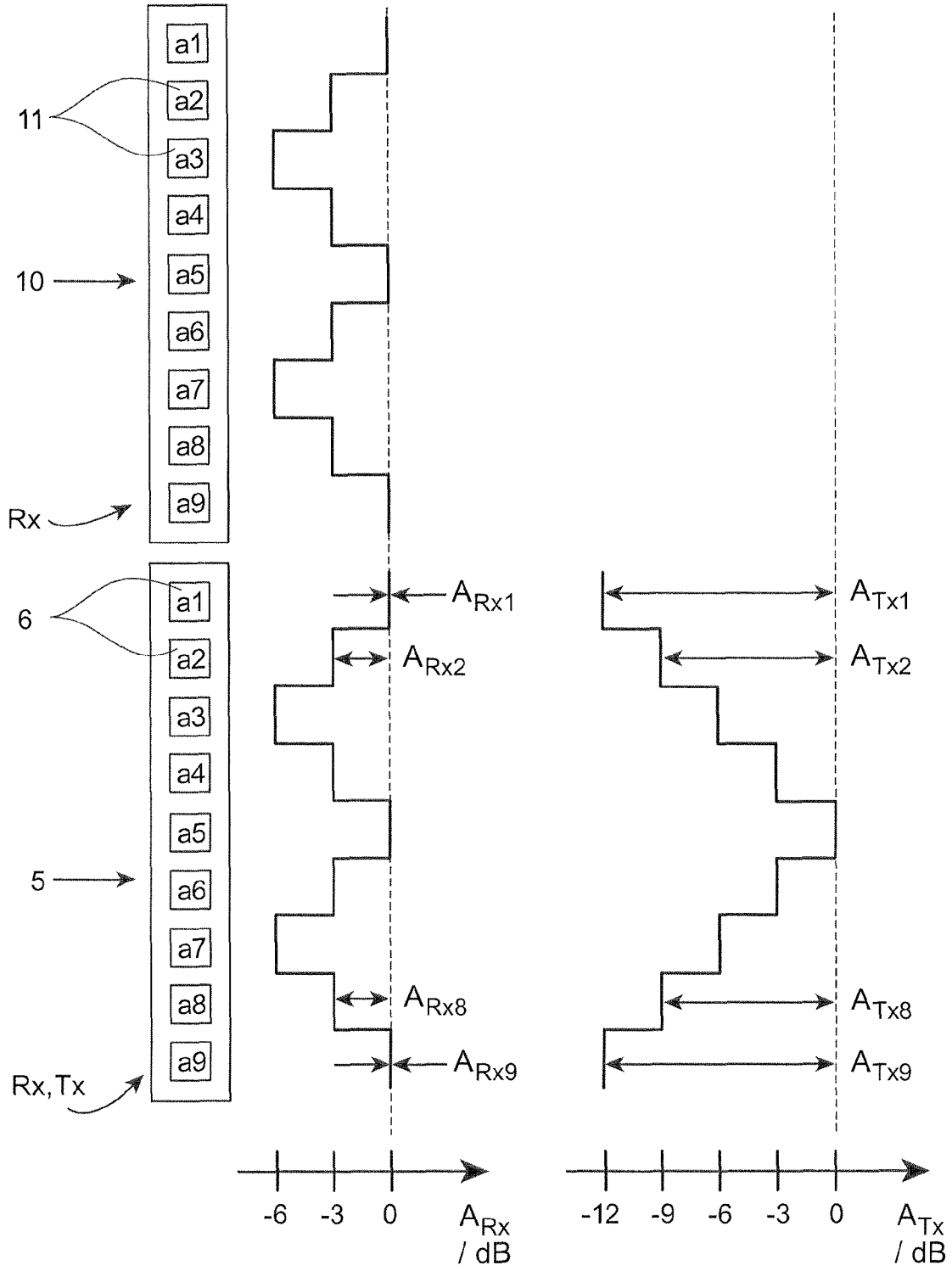
FIGS. 4 to 7 show four further, modified embodiments of an antenna array according to the invention.

In this context, FIG. 4 also discloses a differently stepped amplitude pattern for the receiving operation. In this context, an amplitude distribution is provided over three different level steps, in such a way that the outermost antenna subgroups 6 of the first antenna group 5 and also the outermost antenna subgroup 11 of the second antenna group 10 are at an equal relative amplitude level. The respectively adjacent penultimate antenna subgroups are also at an equal amplitude level, but lower by a step of −3 dB.

In this context, for the first antenna group 5, the figures each show the difference D as provided above, specifically on the one hand in relation to the outermost antenna subgroup and on the other hand in relation to the penultimate antenna subgroup, in each case on the basis of the highest amplitude in relation to any one antenna subgroup 6 which belongs to this first antenna group 5. The difference is calculated from the relative signal level at the respective antenna subgroup in the receiving frequency range and the relative signal level at the respective antenna subgroup in the transmitting frequency range. This difference may result in a value of 12 dB or 6 dB.

Figure 5:
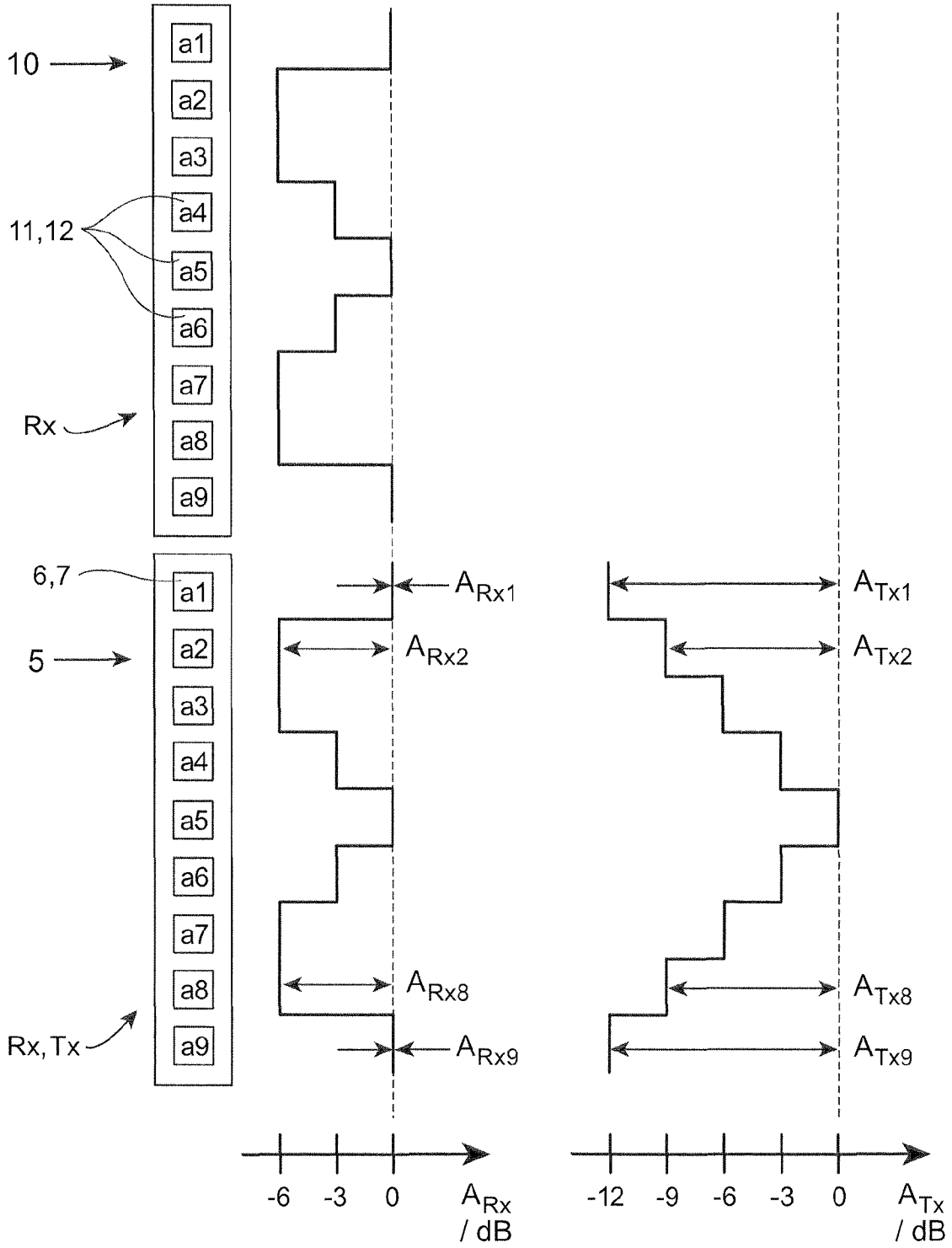
Figure 6:
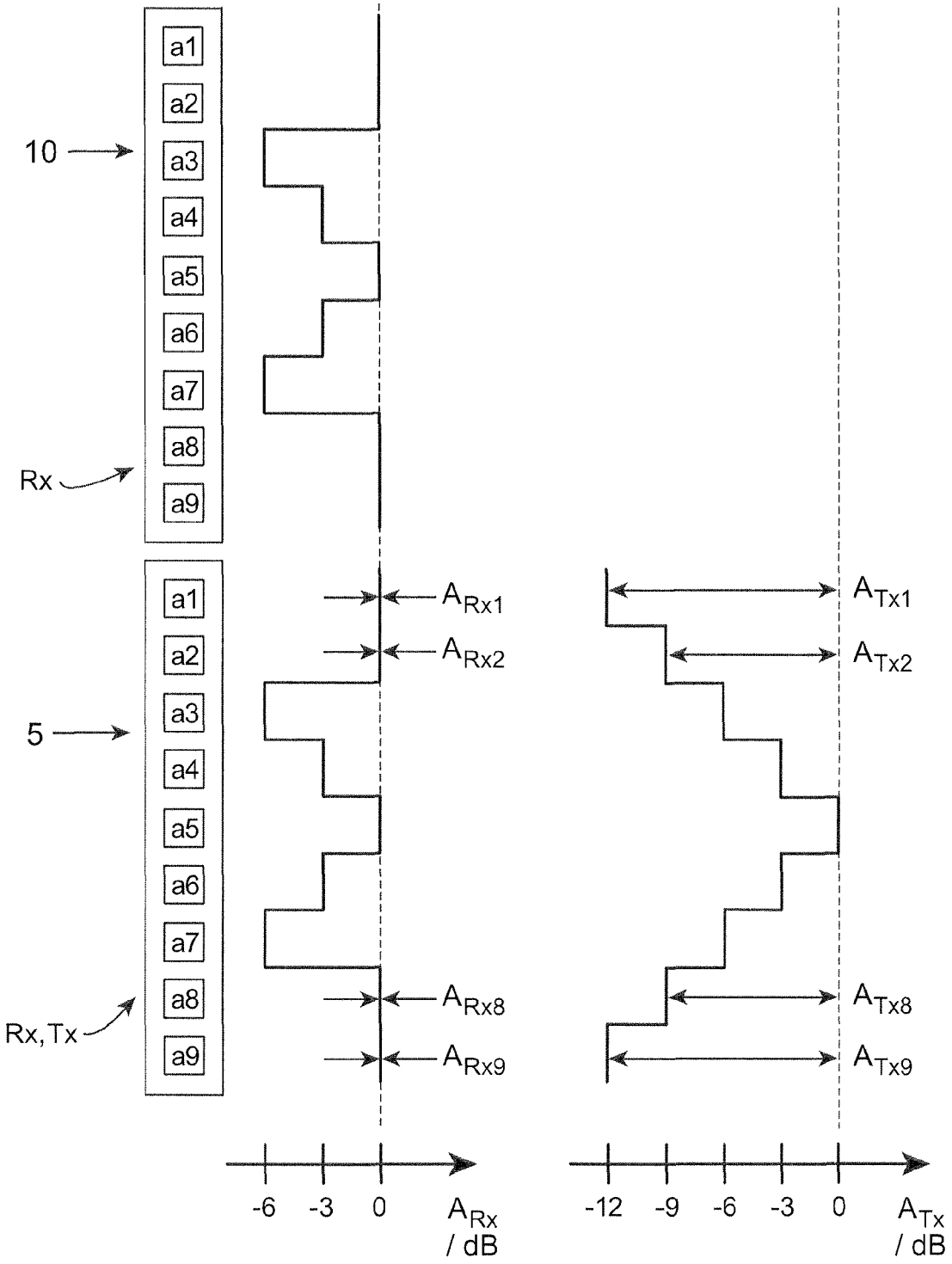
Figure 7:
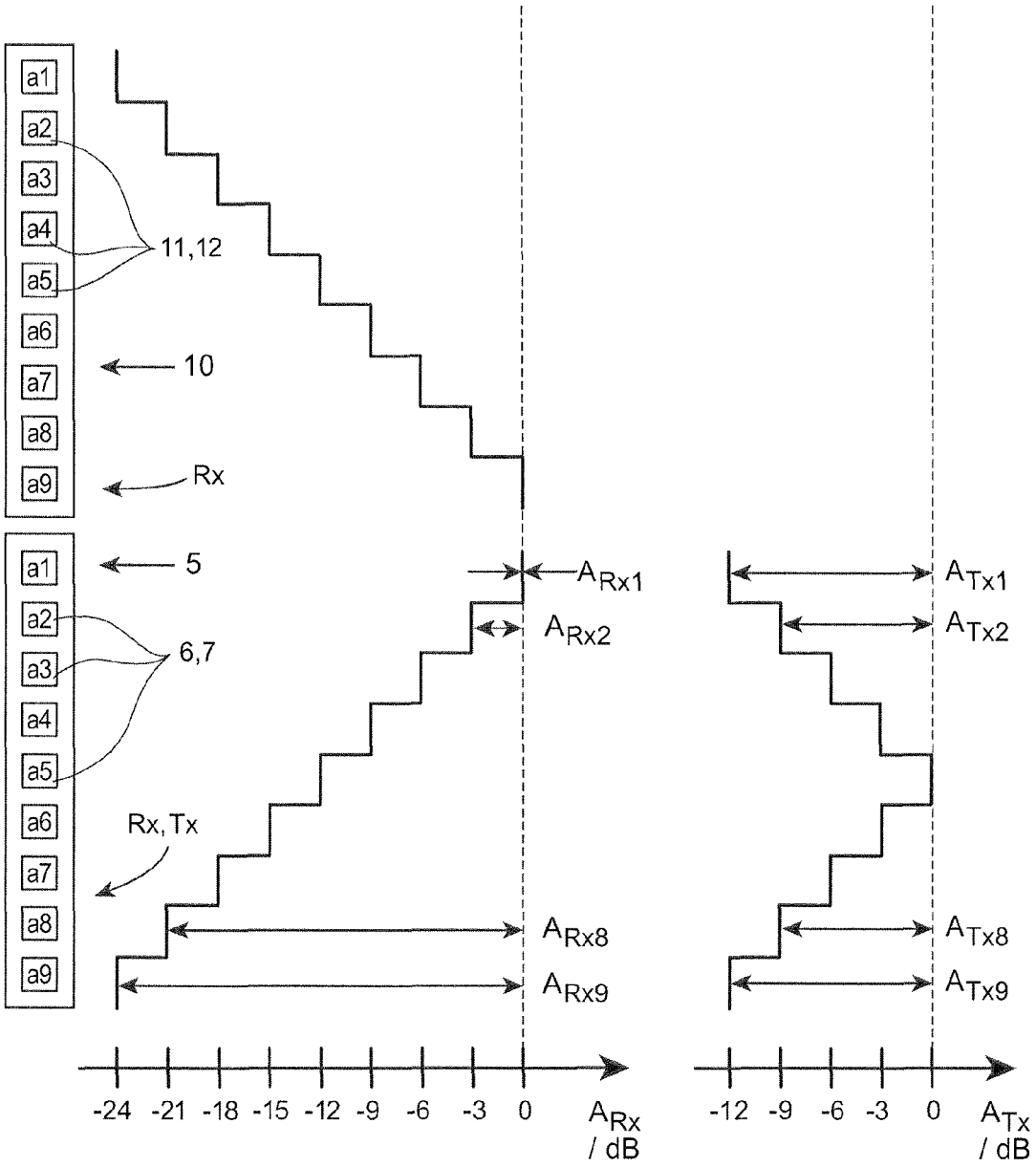

Reference is also made to FIGS. 5, 6 and 7, which show corresponding further modified embodiments.

The values resulting from the embodiments described by way of FIGS. 1 to 7, for the difference D, the relative values $A_{RX}$ and $A_{Tx}$ and the boundary values within which the difference D is intended to move in the context of the invention, are summarised in the following table. In this context, for the embodiments in accordance with FIGS. 1, 2 and 3, the corresponding values are also entered for the case where the corresponding relative amplitude values for the penultimate antenna subgroup are taken into account, rather than the respective outer antenna subgroup, on the basis of the respective highest amplitude of any one antenna subgroup. For this purpose, the second column of the following table specifies whether the difference D of the amplitude of an outer antenna subgroup NM is taken into account in this antenna group on the basis of a maximum amplitude or of the amplitude of a penultimate antenna subgroup V/M on the basis of a maximum amplitude.

FIGS. 9 and 10 show further modifications for an antenna according to the invention, in which the first and second antenna group also each comprise nine antenna subgroups 6 or 11. In this embodiment, the amplitude steps are carried out over the antenna subgroups for receiving operation, as stated in relation to the embodiment in accordance with FIG. 7.

However, whilst in transmitting operation, as in FIG. 7, the first antenna group 5 obtains signals over the antenna subgroups of which the signal level or amplitude decreases in equal steps from the central antenna subgroup (which is denoted as a5) to the outermost antenna groups (denoted as a1 and a9), the embodiment in accordance with FIG. 9 shows a variant in which all of the antenna subgroups 6 are supplied with an equal signal level or an equal amplitude.

In the embodiment in accordance with FIG. 10, in transmitting operation all of the antenna subgroups 6 of the first antenna group 5 obtain an equal signal level (are supplied at the same amplitude), merely the antenna groups a4 and a6 obtaining a signal level or amplitude which is higher by a step of 3 dB.

| FIGURE | A/M V/M | $A_{rx}$ (dB) | $A_{tx}$ (dB) | D (dB) | Z | Min | Max |
|---|---|---|---|---|---|---|---|
| 1 | A/M | 0 | −6 | $D_{1,5}$ = 6 | 5 | 1 | 25 |
| 2 | A/M | 0 | −6 | $D_{1,5}$ = 6 | 5 | 1 | 25 |
| 3 | A/M | 0 | −6 | $D_1$ = 6 | 5 | 1 | 25 |
| 3 | A/M | −12 | −6 | D = 6 | 5 | 1 | 25 |
| 4 | A/M | 0 | −12 | $D_{1,9}$ = 12 | 9 | 1.8 | 45 |
| 4 | V/M | −3 | −9 | $D_{2,8}$ = 6 | 9 | 1.8 | 45 |
| 5 | A/M | 0 | −12 | $D_{1,9}$ = 12 | 9 | 1.8 | 45 |
| 5 | V/M | −6 | −9 | $D_{2,8}$ = 3 | 9 | 1.8 | 45 |
| 6 | A/M | 0 | −12 | $D_{1,9}$ = 12 | 9 | 1.8 | 45 |
| 6 | V/M | 0 | −9 | $D_{2,8}$ = 9 | 9 | 1.8 | 45 |
| 7 | A/M | 0 | −12 | $D_1$ = 12 | 9 | 1.8 | 45 |
| 7 | V/M | −3 | −9 | $D_2$ = 6 | 9 | 1.8 | 45 |
| 7 | V/M | −21 | −12 | $D_8$ = 12 | 9 | 1.8 | 45 |
| 7 | A/M | −24 | −9 | $D_9$ = 12 | 9 | 1.8 | 45 |
| 9 | V/M | −3 | 0 | $D_2$ = 3 | 9 | 1.8 | 45 |
| 9 | V/M | −21 | 0 | $D_8$ = 21 | 9 | 1.8 | 45 |
| 9 | A/M | −24 | 0 | $D_9$ = 24 | 9 | 1.8 | 45 |

-continued

| FIGURE | A/M V/M | $A_{rx}$ (dB) | $A_{tx}$ (dB) | D (dB) | Z | Min | Max |
|---|---|---|---|---|---|---|---|
| 10 | A/M | 0 | −3 | $D_2$ = 3 | 9 | 1.8 | 45 |
| 10 | V/M | −21 | −3 | $D_8$ = 18 | 9 | 1.8 | 45 |
| 10 | A/M | −24 | −3 | $D_9$ = 21 | 9 | 1.8 | 45 |

From the described embodiments, it also becomes clear that the power and amplitude distribution in relation to the antenna subgroups 11 of the upper or second antenna group 10 can also be selected very differently within wide ranges. Preferably, the amplitude distribution is such that the amplitude of the lowest antenna subgroup 11, which is located in the direct vicinity of the lower or first antenna group 5, has an amplitude or power level, that is to say an amplitude, which is preferably equal to the amplitude of the uppermost antenna subgroup 6 of the first antenna group 5, although even in this case there may be some amplitude differences, which where possible are not too large. In the described embodiments, however, these amplitude levels of the directly adjacent antenna subgroups of the first antenna group are at the same level, that is to say are supplied with the same amplitude. Otherwise, however, the amplitude progression over the antenna subgroups 11 of the second antenna group 6 may also be set very differently, as can be seen from the embodiments.

However, in all of these variants it is preferred that in receiving operation, in which both of the antenna groups 5, 10 are used, the receiving signals of the two antenna groups 5, 10 are combined in the transmitting and receiving unit SE, that is to say in the transmitter or receiver, for example in the form of a remote radio head or the like, by modern methods such as MRC (maximum ratio combining) or ERC (equal ratio combining) or similar methods such as IRC or the like. In this context, the individual signals are weighted and corrected in amplitude and phase and combined with one another in an optimum manner. In this way, the result can be expressed as a combined antenna program.

In the described embodiments, amplitude increments of for example 3 dB have been taken as a basis. Of course, in this context any other desired amplitude increments may be used, for example increments of 2 dB, 1.5 dB, or even in increments which have different values from step to step in at least some cases. In this context, the amplitude increment between two adjacent antenna subgroups will generally have a value of between 1 dB and 4 dB, in particular between 2 dB and 3 dB.

It is further noted that the aforementioned phase shifters or phase shifter assemblies 15 are preferably mechanical phase shifters, which are adjustable in particular electrically. Thus, in this way a different downtilt can be provided in relation to the first antenna group 5, but also in relation to the second antenna group 10. Preferably, the downtilt settings of the first and second antenna groups 5, 10 are interconnected. Moreover, it is possible to set or readjust the downtilt in the receiving frequency range separately by means of the transmitting and receiving unit.

In this context, the aforementioned phase shifters 15 not only serve to set the vertical radiation diagram, but preferably also make a frequency-dependent power distribution possible. In other words, the phase shifters have a different power division for the transmitting or downlink operation (Tx) than for the receiving or uplink operation (Rx). In this context, the frequency-dependent amplitude division is generally provided in the supply network N11, N12, N21 or N22, it preferably being possible, as stated, for the frequency-dependent amplitude distribution to be provided by means of the aforementioned phase shifters, in particular in the form of the mechanical phase shifters. However, it is also possible to provide the frequency-dependent amplitude distribution by way of a frequency-dependent power splitter or merely by way of the corresponding supply network in the form of what is known as a distributed system, in which frequency-dependent impedances are formed in or by lines. The phase shifter is thus not necessarily required for the invention, and constitutes a preferred embodiment. Without phase shifters, it would also be possible to create a variant of this system having a downtilt (only in the receiving frequency range using the SE) which cannot be adjusted or can only be adjusted within constraints.

Both for the uplink and for the downlink operation, the phase shifters can be set in such a way that the resulting electrical radiation diagrams make the same vertical downtilt (the same electrical downtilt) or else a different vertical downtilt (electrical downtilt) possible.

The electronics which have been described in the context of the invention are configured in such a way that at least two antenna groups 5, 10 are provided for the uplink or receiving operation and one antenna group 5 is provided for the transmitting or downlink operation and the receiving or uplink operation (or a multiple thereof). It is also possible for example for further antenna groups to be provided for the uplink operation, for example three antenna groups for the uplink operation (only one antenna group out of the three antenna groups also additionally being used for the downlink operation).

Further, it is again noted that applications are also conceivable in which both of the antenna groups are used in transmitting operation. Thus, in particular for example an intelligent method such as MIMO, SIMO or MISO may be used, in the same way as joint operation of the antennas is possible in downlink operation, for example so as to achieve a higher antenna gain. As is known, in broadcasting, the aforementioned methods MIMO, SIMO or MISO involve the use of a plurality of transmitting and receiving antennas for wireless communication, MIMO involving the use of a plurality of transmitting and receiving antennas, SIMO involving the use of one transmitting and a plurality of receiving antennas, and MISO involving a transmission in which a plurality of transmitting antennas are used, but only one receiving antenna.

The invention has been described by way of antenna arrays which are operated with what are known as X-polarised radiators, that is to say dual-polarised radiators. As stated, they may also be single-polarised radiators, however. In particular if dual-polarised radiators are used, it is also possible for the amplitude distribution according to the invention only to be applied to one polarisation, or else for different amplitude distributions according to the invention to be made use of for each polarisation.

Finally, however, other completely different embodiments and modes of operation having other level differences are also possible. For this purpose, reference is also made to the following additional table, in which further level differences are given which are expedient for the operation according to the invention of the antenna system. In the first column, the respective operating types are named in a manner corresponding to the figures. The columns $A_{Rx}$ and $A_{Tx}$ specify amplitudes which may be expedient alongside the previously mentioned embodiments. The level differences are provided accordingly.

| Embodiment according to FIG. | $A_{Rx}$/dB | $A_{Tx}$/dB | D/dB |
|---|---|---|---|
| 1 | 0 | −2 | $D_{1,5} = 2$ |
| 1 | 0 | −4 | $D_{1,5} = 4$ |
| 2 | 0 | −2 | $D_{1,5} = 2$ |
| 2 | 0 | −4 | $D_{1,5} = 4$ |
| 3 | 0 | −2 | $D_1 = 2$ |
| 3 | −4 | −2 | $D_5 = 2$ |
| 3 | 0 | −4 | $D_1 = 4$ |
| 3 | −8 | −4 | $D_5 = 4$ |
| 4 | 0 | −4 | $D_{1,9} = 4$ |
| 4 | 0 | −8 | $D_{1,9} = 8$ |
| 4 | −1 | −4 | $D_{2,8} = 3$ |
| 4 | −2 | −8 | $D_{2,8} = 6$ |
| 5 | 0 | −4 | $D_{1,9} = 4$ |
| 5 | 0 | −8 | $D_{1,9} = 8$ |
| 5 | −2 | −4 | $D_{2,8} = 2$ |
| 5 | −4 | −8 | $D_{2,8} = 4$ |
| 6 | 0 | −4 | $D_{1,9} = 4$ |
| 6 | 0 | −8 | $D_{1,9} = 8$ |
| 6 | 0 | −4 | $D_{2,8} = 4$ |
| 6 | 0 | −8 | $D_{2,8} = 8$ |
| 7 | 0 | −4 | $D_1 = 4$ |
| 7 | 0 | −8 | $D_1 = 8$ |
| 7 | −1 | −3 | $D_2 = 2$ |
| 7 | −2 | −6 | $D_2 = 4$ |
| 7 | −7 | −3 | $D_8 = 4$ |
| 7 | −14 | −6 | $D_8 = 8$ |
| 7 | −8 | −4 | $D_9 = 4$ |
| 7 | −16 | −8 | $D_9 = 8$ |
| 9 | −1 | 0 | $D_2 = 1$ |
| 9 | −2 | 0 | $D_2 = 2$ |
| 9 | −7 | 0 | $D_8 = 7$ |
| 9 | −14 | 0 | $D_8 = 14$ |
| 9 | −8 | 0 | $D_9 = 8$ |
| 9 | −16 | 0 | $D_9 = 16$ |
| 10 | 0 | −1 | $D_1 = 1$ |
| 10 | 0 | −2 | $D_1 = 2$ |
| 10 | −7 | −1 | $D_8 = 6$ |
| 10 | −14 | −2 | $D_8 = 12$ |
| 10 | −8 | −1 | $D_9 = 7$ |
| 10 | −16 | −2 | $D_9 = 14$ |

The invention claimed is:

1. Active antenna system comprising:

a first antenna group which is provided for transmitting and receiving operation, a second antenna group provided for receiving operation, the two antenna groups being arranged so one of the antenna groups is above the other antenna group, each antenna group comprising at least two antenna subgroups, each antenna subgroup comprising at least one radiator, the first antenna subgroup being interconnected via a first supply network, the second antenna subgroups being interconnected via a second supply network different than the first supply network, the first and second supply networks providing phase shifters configured to provide frequency-dependent amplitudes distributions for the first and second antenna groups, respectively, the first and second antenna groups being connected to a shared transmitting and receiving unit, the first supply network of the first antenna group having an amplitude distribution which is dependent on a transmitting and a receiving frequency, the first supply network being constructed in such a way that the following amplitude distribution condition is met $$Z*0.2\text{ dB} \leq |A_{Rx} - A_{Tx}| \leq Z*5.0\text{ dB}$$

where $A_{Rx}$ is the amplitude of an outer or penultimate antenna subgroup on the basis of the maximum amplitude of the antenna subgroups at a receiving frequency, $A_{Tx}$ is the amplitude of the outer or penultimate antenna subgroup based on the highest amplitude of the antenna subgroups at a transmitting frequency, and Z is the number of antenna subgroups of the first antenna group.

2. Antenna system according to claim 1, wherein the antenna system is configured in such a way that the first and second antenna groups are used in receiving operation.

3. Antenna system according to claim 1, wherein the antenna system is configured in such a way that only the first antenna group is used in transmitting operation.

4. Antenna system according to claim 1, wherein the transmitting and receiving unit is constructed in such a way that the signals which are received via the first and second antenna groups are processed by a maximum ratio combining, equal ratio combining or interference rejection combining method.

5. Antenna system according to claim 1, wherein the phase shifters comprise mechanical phase shifters.

6. Antenna system according to claim 1, wherein the first and second supply networks further comprise frequency-dependent power splitters.

7. Antenna system according to claim 1, wherein the phase shifters have a frequency-dependent power share for setting the radiation downtilt.

8. Antenna system according to claim 1, wherein the antenna system further comprises a third antenna group, the first, second and third antenna groups being configured for the receiving operation and the first antenna group being provided for the transmitting operation.

9. Antenna system according to claim 1, wherein the antenna groups comprise an equal number of antenna subgroups and/or the antenna subgroups comprise an equal number of radiators.

10. Antenna system according to claim 9, wherein the radiators of an antenna subgroup are supplied with a phase difference.

11. Antenna system according to claim 1, wherein the antenna system comprises electrically adjustable radiation downtilt phase shifters.

12. Antenna system according to claim 11, wherein the radiation downtilt phase shifters of the antenna groups are interconnected.

13. Antenna system according to claim 1, wherein the antenna system can be operated by means of the transmitting and receiving unit and/or the first and second supply networks in such a way that the resulting electrical radiation diagram for the receiving and transmitting operation can be set to a different vertical downtilt, by setting the different phase shift and/or a different power division between the receiving and the transmitting operation.

14. Antenna system according to claim 1, wherein the antenna system can be operated by the transmitting and receiving unit and/or the first and second supply networks in such a way that the resulting electrical radiation diagram can be set to an equal vertical downtilt for the receiving and the transmitting operation.

15. Antenna system according to claim 1, wherein the first and second antenna groups are of the same type.

16. Antenna system according to claim 1, wherein the antenna system is constructed in such a way that the second antenna group is also used in the transmitting operation.

17. Antenna system according to claim 16, wherein the antenna system is constructed in such a way that the transmitting and receiving unit uses the first and second antenna groups in the context of a MIMO, SIMO or MISO, wherein MIMO involves the use of a plurality of transmitting and receiving antennas, SIMO involves the use of one transmitting and a plurality of receiving antennas, and MISO involves a transmission in which a plurality of transmitting antennas are used, but only one receiving antenna.

18. Antenna system according to claim 1, wherein the radiators of the antenna subgroups of the antenna groups are dual polarized, linearly (±45°, horizontally or vertically), circularly (left-handed or right-handed) or elliptically.

19. Antenna system according to claim 18, wherein the antenna system is constructed in such a way that a different frequency-dependent power distribution is implemented or used for only one of the two polarizations, or in such a way that a different frequency-dependent power distribution is implemented or used for each of the two polarizations of the dual-polarized radiators.

20. Antenna system according to claim 1, wherein the antenna system is constructed in such a way that the antenna subgroups of the first antenna group are operated in transmitting operation at a different power, a central antenna subgroup being supplied with the highest amplitude, while the amplitudes decrease in steps to the outermost antenna subgroup, the change in amplitude from the antenna subgroup to the antenna subgroup being between 1 dB and 4 dB.

21. Antenna system according to claim 1, wherein the antenna system is constructed in such a way that when the first antenna group is in transmitting operation, the antenna subgroups are supplied with approximately the same power or amplitude or only individual antenna subgroups receive more power than the remaining antenna subgroups.

22. Antenna system according to claim 1, wherein the antenna system is constructed in such a way that the power or amplitude distribution of the antenna subgroups of the first antenna group is symmetrical about a central antenna subgroup or two central antenna subgroups in receiving operation and/or in transmitting operation, and/or in that approximately the same power or amplitude distribution is used.

23. Antenna system according to claim 1, wherein the antenna system is constructed in such a way that in receiving operation the antenna subgroup, which is provided immediately adjacent to the second antenna group, of the first antenna group is operated at the highest power or amplitude, and each subsequent antenna subgroup of the first antenna group up to the outermost antenna subgroup, which is the furthest away from the second antenna group, obtains lower power or amplitude values in steps.

24. Antenna system according to claim 23, wherein the amplitude distribution of the antenna subgroups of the second antenna group at a receiving frequency is selected in such a way that the overall amplitude distribution of all of the antenna subgroups of the two antenna groups at a receiving frequency substantially corresponds to a progression which decreases from the inner to the outer antenna subgroups, as considered over the antenna system as a whole.

25. Antenna system according to claim 1, wherein the amplitude distribution in relation to the antenna subgroups of the first antenna group corresponds to the amplitude distribution of the antenna subgroups of the second antenna group.

26. Antenna system according to claim 1, wherein the amplitude of the antenna subgroup of the first antenna group directly adjacent to the second antenna group has a value which corresponds to the amplitude of the lowest antenna subgroups of the second antenna group.

27. Antenna system according to claim 1, wherein the first supply network is constructed in such a way that the following condition is met $$Z^*x \text{ dB} \leq |A_{Rx} - A_{Tx}| \leq Z^*y \text{ dB}$$

wherein x corresponds to a value of 0.3 and/or preferably 0.4, and y corresponds to a value of 4.0 or 3.0 or preferably 2.5 or 2.0.

28. Active antenna system comprising:

a first antenna group configured to transmit and receive, the first antenna group being interconnected via a first phase shifter supply network and comprising a first set of plural antenna subgroups including an outer or penultimate antenna subgroup, each of the plural antenna subgroups comprising at least one radiator;

a second antenna group configured to receive only, the second antenna group being interconnected via a second phase shifter supply network different from the first phase shifter supply network and comprising a second set of plural antenna subgroups each comprising at least one radiator;

the first and second antenna groups being arranged so one of the first and second antenna groups is above the other of the first and second antenna groups, a shared transmitting and receiving unit connected to the first and second antenna groups, the first supply network comprising phase shifters configured to provide phases and amplitude distributions for the first antenna group, the first supply network having an amplitude distribution which is dependent on a transmit and receive frequency, the first supply network being constructed in such a way that the following condition is met $$Z^*0.2 \text{ dB} \leq |A_{Rx} - A_{Tx}| \leq Z^*5.0 \text{ dB}$$

where $A_{Rx}$ is the amplitude of the outer or penultimate antenna subgroup on the basis of the maximum amplitude of the first set of plural antenna subgroups at a receiving frequency, $A_{Tx}$ is the amplitude of the outer or penultimate antenna subgroup based on the highest amplitude of the first set of plural antenna subgroups at a transmitting frequency, and Z is the number of antenna subgroups of the first set of plural antenna subgroups.

* * * * *